US008099036B2

(12) United States Patent
Morishita

(10) Patent No.: US 8,099,036 B2
(45) Date of Patent: Jan. 17, 2012

(54) IMAGE PROCESSING APPARATUS, IMAGE PROCESSING METHOD, AND COMPUTER PROGRAM

(75) Inventor: Kouichi Morishita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1016 days.

(21) Appl. No.: 11/968,886

(22) Filed: Jan. 3, 2008

(65) Prior Publication Data

US 2008/0226368 A1 Sep. 18, 2008

(30) Foreign Application Priority Data

Mar. 16, 2007 (JP) ..... 2007-069535

(51) Int. Cl.
*G03G 21/00* (2006.01)

(52) U.S. Cl. ..... 399/366; 399/376

(58) Field of Classification Search ..... 399/366
See application file for complete search history.

(56) References Cited

U.S. PATENT DOCUMENTS 6,167,147 A * 12/2000 Mowry et al. ..... 382/135
6,546,129 B1 * 4/2003 Ohta et al. ..... 382/162
6,901,236 B2 * 5/2005 Saitoh et al. ..... 399/366
7,599,099 B2 * 10/2009 Tamaru ..... 358/3.28
2004/0170275 A1 * 9/2004 Lee et al. ..... 380/54
2005/0041263 A1 * 2/2005 Ishikawa et al. ..... 358/1.14
2005/0058476 A1 * 3/2005 Murakami ..... 399/366

FOREIGN PATENT DOCUMENTS

JP 2004-78752 3/2004
JP 2005-94326 4/2005
JP 2006-345394 12/2006

OTHER PUBLICATIONS

Office Action issued Mar. 8, 2011, in Japanese Patent Application No. 2007-069535.

* cited by examiner

*Primary Examiner* — Anthony Nguyen
(74) *Attorney, Agent, or Firm* — Oblon, Spivak, McClelland, Maier & Neustadt, L.L.P.

(57) ABSTRACT

A disclosed image processing apparatus is capable of shifting an illegal copy preventing pattern so that an image reading device can recognize the pattern printed at the edge end of the printing range on a paper even when the printing range on the paper is changed by, for example, trimming and user settings. The apparatus includes an image output unit outputting an image to a prescribed region; an output position setting unit acquiring output region information, comparing the output region information with the illegal copy preventing pattern; and determining an output position of the illegal copy preventing pattern based on the comparison result, and a combining unit combining the illegal copy preventing pattern and image data based on the output position determined by the output position setting unit. The image output unit outputs the image combined by the combining unit.

6 Claims, 16 Drawing Sheets

P1: UNIT PATTERN

IMAGE PROCESSING APPARATUS, IMAGE PROCESSING METHOD, AND COMPUTER PROGRAM

BACKGROUND OF THE INVENTION

1. Field of the Invention

The present invention relates to an image processing apparatus, an image processing method, a computer program, and a recording medium capable of combining an image and an illegal copy preventing pattern to output the combined image.

2. Description of the Related Art

As one of the illegal copy preventing patterns for preventing illegal or unauthorized copying, so-called embedded patterns have been used. FIG. 18 is a schematic block diagram of a conventional image processing apparatus capable of combining the embedded pattern as the illegal copy preventing pattern and an image and outputting the combined image. As shown in FIG. 18, the image processing apparatus generally includes an image input section 1, an image processing section 2 having an illegal copy preventing pattern generating section 2*a*, an illegal copy preventing pattern combining section 3, and an image output section 4. By this configuration, an input image input from the image input section 1 and an illegal copy preventing pattern generated in the illegal copy preventing pattern generating section 2*a* are combined in the illegal copy preventing pattern combining section 3 from which the combined image is output.

Also, as known techniques for printing an embedded pattern and generating an embedded pattern, there are inventions disclosed in Patent Documents 1 and 2 described below. Patent Document 1 discloses a print control method used in a printing system including a printer, an administrator host device, and a user host device, each connected to the others via a network. In this method, when a print instruction is transmitted from the user host device to the printer, a printer driver generating print data inquires about the administrative information stored in the administrator host device. Then, when the name of the user is found in the administrative information, the embedded pattern printing is performed.

On the other hand, Patent Document 2 discloses a method of generating an embedded pattern image used in an image processing apparatus generating the embedded pattern image including a latent image part and a background part. This method includes a determining step of determining the combination of the latent image pattern constituting the latent image part and the background pattern constituting the background part so that the printing density of the latent image part is substantially equal to that of the background part; an inputting step of inputting the determined latent pattern and background pattern, wherein color information determines the color of the embedded pattern image, input image information indicates an image to be processed, processing region information designates the region to be processed in the input image, region designating information designates the latent part and the background part, and camouflage region designation image information designates a white-background region; and a generating step of generating an embedded image based on each input information item.

Patent Document 1: Japanese Patent Application Publication No.: 2004-078752

Patent Document 2: Japanese Patent Application Publication No.: 2005-094326

However, unfortunately, the conventional techniques using an illegal copy preventing pattern as an embedded pattern may have a problem when there are no image data printed in the margin of a paper to be printed, since trimming of images is performed to generate a white-background region in the margin on the paper. In this case, since no illegal copy preventing pattern is printed in the peripheral region on the paper, an image reading device and an image processing device may perform a copy operation without recognizing the illegal copy preventing pattern. As a result, the function of the illegal copy preventing pattern may not be performed as desired since the image reading device and the image processing device cannot recognize an illegal copy.

Further, when there is a mismatch between the size of a unit pattern constituting a generated illegal copy preventing pattern and the size of the printing paper, and the mismatched illegal copy preventing pattern is printed on the paper, unfortunately, some unit patterns may be fragmented (truncated). As a result, similarly, the function of the illegal copy preventing pattern may not be performed as desired since the image reading device and the image processing device cannot recognize an illegal copy.

SUMMARY OF THE INVENTION

This invention is made in light of the above problems and may provide an image processing apparatus, an image processing method, a computer program, and a recording medium capable of forming or printing an illegal copy preventing pattern so that an image reading device and an image processing device can successfully recognize the illegal copy preventing pattern whether or not trimming is performed or there is the mismatch between the size of the unit pattern constituting the illegal copy preventing pattern and the size of the printing paper.

To solve the problems, according to one aspect of the present invention, there is provided an image processing apparatus capable of outputting an illegal copy preventing pattern on a paper. The apparatus includes an image output unit outputting an image to a prescribed region, an output position setting unit acquiring output region information defining the prescribed region from the image output unit, comparing the output region information with the illegal copy preventing pattern, and determining an output position of the illegal copy preventing pattern based on the result of the comparison, and a combining unit combining the illegal copy preventing pattern and image data based on the output position determined by the output position setting unit, wherein the image output unit outputs the image data combined by the combining unit.

According to another aspect of the present invention, the image output unit is an image output engine trimming image data and printing the trimmed image data, and the output position setting unit acquires trimming information about the trimming, compares the trimming information with the illegal copy preventing pattern, and determines the output position of the illegal copy preventing pattern based on the result of the comparison.

According to still another aspect of the present invention, the image processing apparatus further includes a generating unit adjusting the output position of the illegal copy preventing pattern based on the output region information defining the prescribed region, and generating the adjusted illegal copy preventing pattern.

According to still another aspect of the present invention, the image processing apparatus further includes a determining unit determining whether the back end of the illegal copy preventing pattern can be normally output, wherein when it is determined that the back end of the illegal copy preventing pattern cannot be normally output, the output position setting unit adjusts the output position of the illegal copy preventing pattern so that the back end of the illegal copy preventing pattern corresponds to the back end of the prescribed region.

According to still another aspect of the present invention, the generating unit generates the illegal copy preventing pattern based on an effective print range on each page in addition to the trimming information.

According to still another aspect of the present invention, the generating unit generates illegal copy preventing patterns for the corresponding pages when intensive printing is performed.

According to still another aspect of the present invention, the generating unit generates the illegal copy preventing patterns based on the effective print ranges of the corresponding pages when intensive printing is performed.

According to still another aspect of the present invention, there is provided an image processing method for a device including an image output unit outputting an image to a prescribed region, capable of outputting an illegal copy preventing pattern on a paper. The method includes the steps of acquiring output region information defining the prescribed region from the image output unit; comparing the output region information with the illegal copy preventing pattern, determining an output position of the illegal copy preventing pattern based on the result of the comparison, combining the illegal copy preventing pattern and image data based on the determined output position; and outputting the combined image data.

According to still another aspect of the present invention, there is provided a computer-readable and computer-executable program for a device including an image output unit outputting an image to a prescribed region, capable of outputting an illegal copy preventing pattern on a paper. The program includes the instructions for acquiring output region information defining the prescribed region from the image output unit, comparing the output region information with the illegal copy preventing pattern, determining an output position of the illegal copy preventing pattern based on the result of the comparison, combining the illegal copy preventing pattern and image data based on the determined output position, and outputting the combined image data.

According to still another aspect of the present invention, there is provided a recording medium storing the program described above.

In the embodiments described below, it should be noted that the image output unit, the output position setting unit, the combining unit, the generating unit, and the determining unit correspond to an image output section (printing device) 4, an image processing section 2 including an illegal copy preventing pattern output position controlling section 2*c*, an illegal copy preventing pattern combining section 3, an illegal copy preventing pattern generating section 2*a*, and an illegal copy preventing pattern output position calculating section 2*f* and an illegal copy preventing pattern seize detecting section 2*e*, respectively.

According to an embodiment of the present invention, an output position of an illegal copy preventing pattern is adjusted so that the illegal copy preventing pattern can be read by an image reading device and an image processing device even when trimming is performed or there is a mismatch between the size of the unit pattern constituting the illegal copy preventing pattern and the size of an effective print size of the paper to be printed.

DETAILED DESCRIPTION OF THE PREFERRED EMBODIMENTS

In the following, embodiments of the present invention are described with reference to the accompanying drawings.

Embodiment 1

Figure 1:
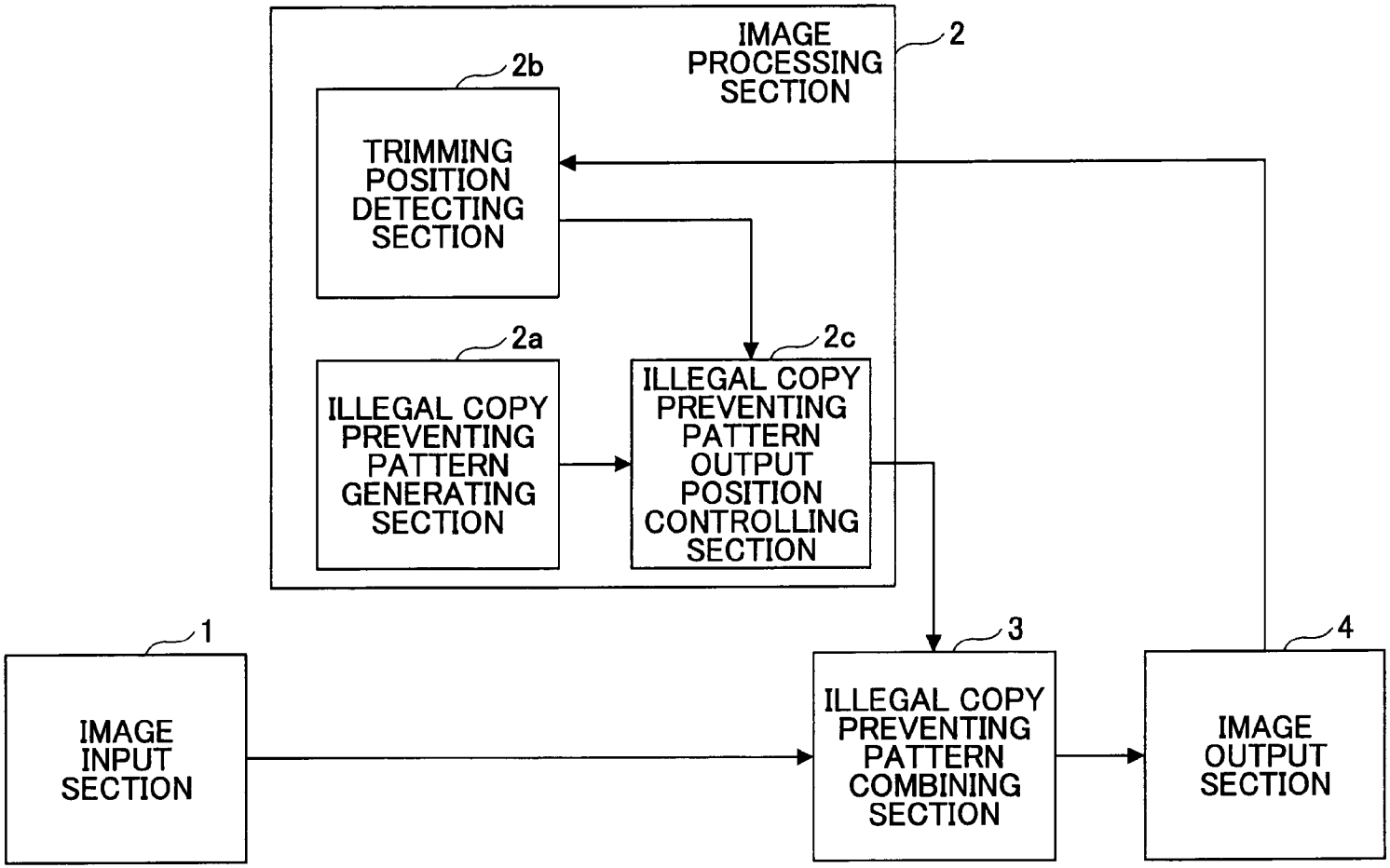
FIG. 1 is a schematic block diagram of an image processing apparatus according to a first embodiment of the present invention.
Figure 18:
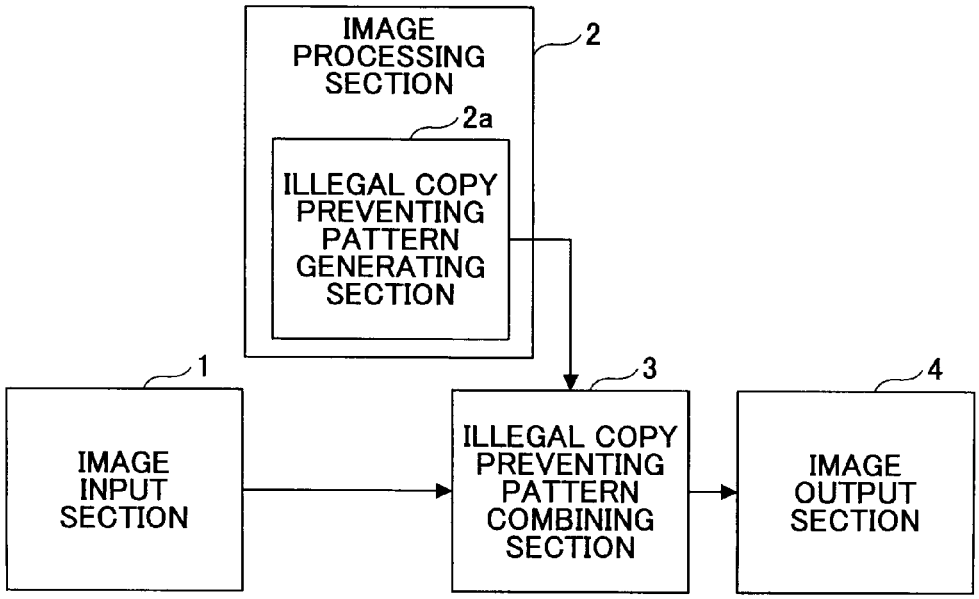
FIG. 18 is a schematic block diagram of a conventional image processing apparatus.

FIG. 1 is a schematic block diagram showing an image processing apparatus according to a first embodiment of the present invention. As shown in FIG. 1, the image processing apparatus includes an image input section 1, an image processing section 2, an illegal copy preventing pattern combining section 3, and an image output section 4. These sections are the same as those of the conventional apparatus shown in FIG. 18 except that the image processing unit 2 further includes a trimming position detecting section 2*b* and an illegal copy preventing pattern output position controlling section 2*c* in addition to the illegal copy preventing pattern generating section 2*a*. By this configuration, output image data are output from the image output section 4 to the trimming position detecting section 2*b*. Based on the output data, the trimming position detecting section 2*b* outputs a trimming position of an illegal copy preventing pattern P to the illegal copy preventing pattern output position controlling section 2*c*.

The illegal copy preventing pattern output position controlling section 2*c* determines the output position of the illegal copy preventing pattern P based on the received trimming position and the illegal copy preventing pattern P and then transmits the determined output position information to the illegal copy preventing pattern combining section 3. The illegal copy preventing pattern combining section 3 combines the illegal copy preventing pattern P based on the received output position information and the printing image data from the image input section 1 and transmits the combined information to the image output section 4. The image output section 4 outputs an image combining the illegal copy preventing pattern P and the input image data.

Figure 2:
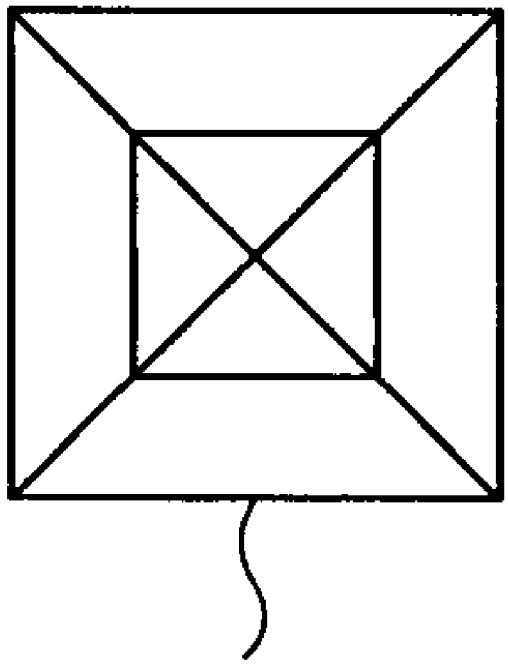
FIG. 2 is a drawing showing a minimum unit pattern constituting an illegal copy preventing pattern.

FIG. 2 shows an example of a minimum unit pattern P1 constituting the illegal copy preventing pattern P. Namely, the unit pattern P1 is a unit of the illegal copy preventing pattern P and the illegal copy preventing pattern P is generated by sequentially arranging plural unit patterns P in both main scanning and sub scanning directions so that the generated illegal copy preventing pattern P is formed on the whole paper as shown in FIG. 3B. It should be noted that the size and the shape of the unit pattern P1 are arbitrarily defined and appropriately set in accordance with, for example, the resolution of the reading device to be used. Though the unit patterns P1 are formed relatively larger for illustrative purposes in the figures, the typical side length of the unit pattern P1 may be in a range between 128 to 256 dots.

Figure 3A:
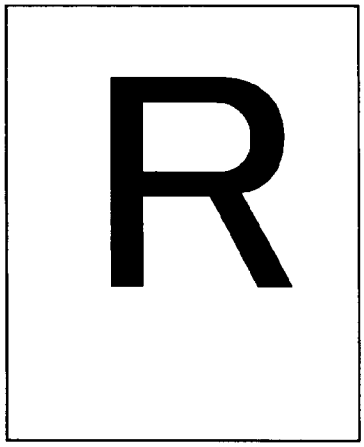
FIGS. 3A through 3C show a process of combining the illegal copy preventing pattern and an input image.
Figure 3B:
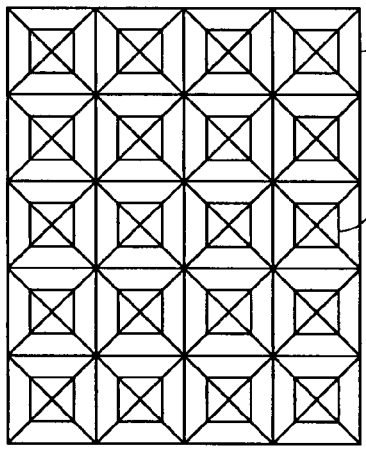
Figure 3C:
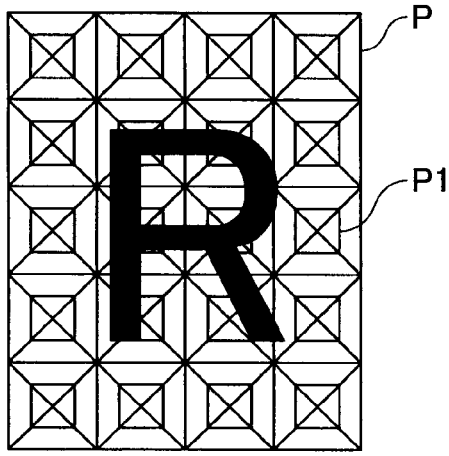

FIGS. 3A through 3C shows a process of combining an illegal copy preventing pattern and an input image. Specifically, FIG. 3A shows input image data to be printed. FIG. 3B shows the illegal copy preventing pattern P formed on the whole of a paper by arranging plural unit patterns P1. FIG. 3C shows the image to be output generated by combining the image data and the illegal copy preventing pattern P1.

Figure 4:
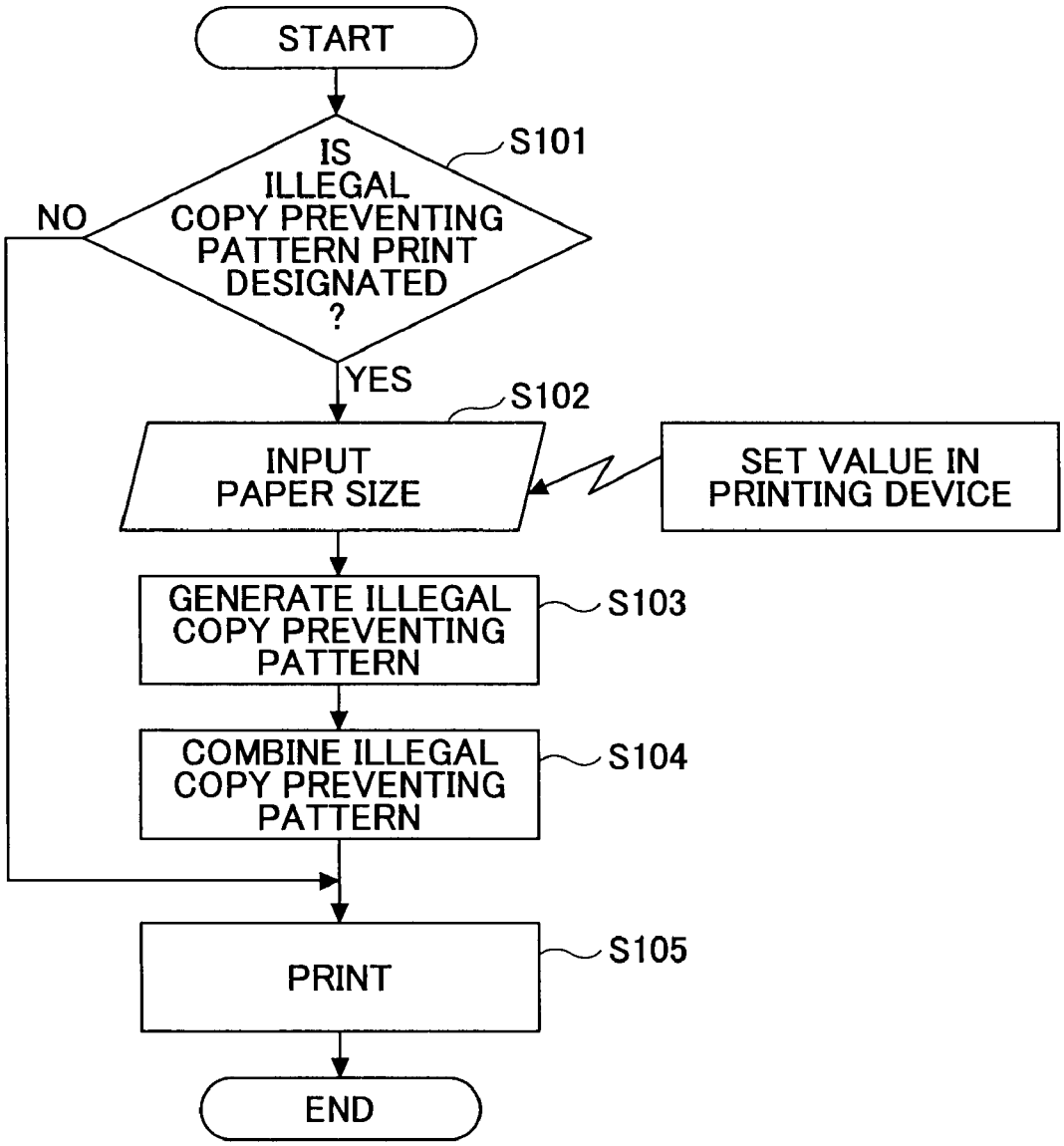
FIG. 4 is a flowchart showing a printing process of the illegal copy preventing pattern according to a first embodiment of the present invention.

FIG. 4 is a flowchart showing a printing process up to the output of the combined image as shown in FIG. 3C using the illegal copy preventing pattern according to a first embodiment of the present invention. In FIG. 4, when printing the illegal copy preventing pattern is designated (step S101), the illegal copy preventing pattern generating section 2*a* acquires the size data of the printing paper from a printing device (step S102). The illegal copy preventing pattern generating section 2*a* arranges the plural unit patterns P1 to generate the illegal copy preventing pattern P so that the size of the generated illegal copy preventing pattern P is the same as that of the printing paper (step S103) as shown in FIG. 3B. In this case, since no trimming is performed, the illegal copy preventing pattern combining section 3 combines the printing data from the image input section 1 and the illegal copy preventing pattern P so that the illegal copy preventing pattern is printed from the end of the paper based on the position information from the illegal copy preventing pattern position controlling section 2*c* (step S104) and transmits the combined image data to the image output section (printing device) 4 to print the combined image (step S105).

As described above, according to this embodiment of the present invention, an illegal copy preventing pattern in accordance with the size of the printing paper can be generated.

Embodiment 2

In the above first embodiment, an image is printed on the entire printing paper. However, there may be some cases where specific trimming for each type of printing device is performed for generating a non-printing area on a printing paper so as to avoid the lap-feeding of a header of a paper and the contamination of a conveying path of a printing paper in the printing device. The size of the trimming is designated to be different for each printing device.

Figure 5A:
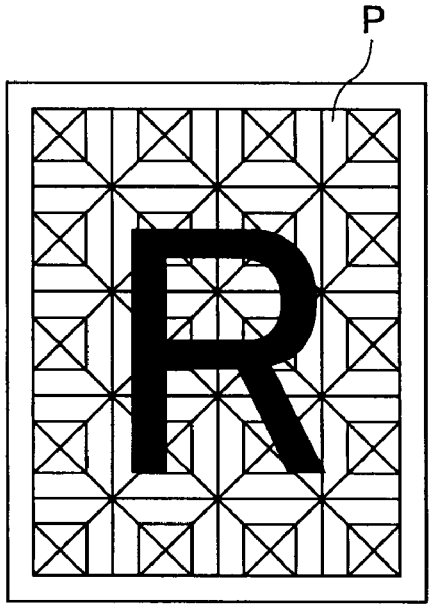
FIGS. 5A and 5B are drawings illustrating images after the trimming the image data in the margin of a printing paper is performed.
Figure 5B:
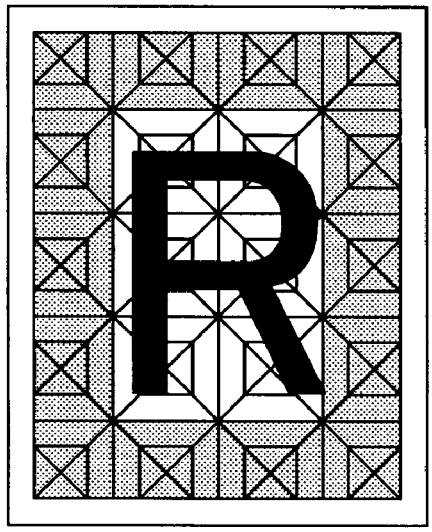

When the trimming is directly performed on the image of FIG. 3C, a white image region is formed on the image of FIG. 3C along the margins of the paper as shown in FIG. 5A. Unfortunately, when a white image region is directly generated by the trimming, the unit patterns P1 included in the white image region may be fragmented (truncated), as shown in FIG. 5A. It is generally known that an image reading device and an image processing device can recognize the illegal copy preventing pattern P when the image reading device and the image processing device read the complete unit pattern P1. Because of this feature, unfortunately, the image reading device and the image processing device cannot recognize the unit pattern P1 in the shaded area in FIG. 5B because each pattern of the unit pattern P1 is fragmented in the shaded area. As a result, the image reading device and the image processing device can not recognize the unit pattern until reading the second unit pattern P1 when counted from the edge (end). Therefore, the image reading device and the image processing device disadvantageously recognize that the region of the illegal copy preventing pattern P is defined only inside the second unit pattern P1.

Figure 6:
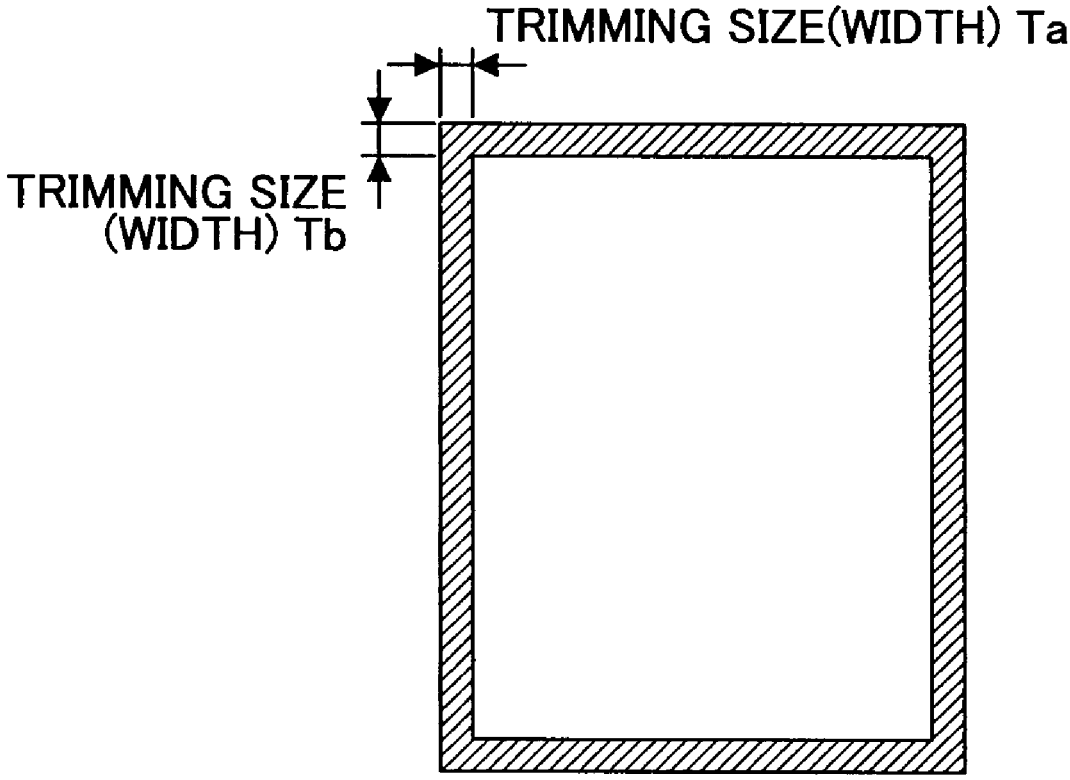
FIG. 6 is a drawing showing trimming size (width) information set in a printing device.
Figure 7A:
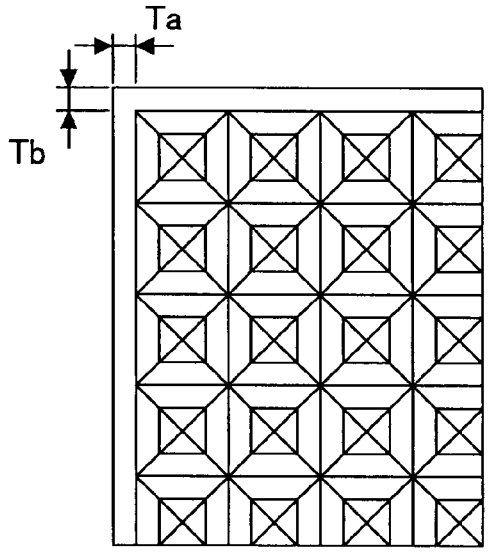
FIG. 7A is a drawing showing an image of a shifted illegal copy preventing pattern based on the trimming size (width) information.
Figure 7B:
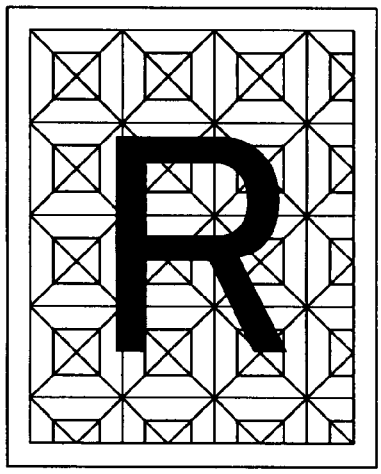
FIG. 7B is a drawing showing an image after shifting the illegal copy preventing pattern and an image to be printed are combined with each other.

To overcome this disadvantage, in this second embodiment of the present invention, the illegal copy preventing pattern P1 is formed so that the first unit pattern P1 when counted from the edge can be surely recognized when the unit pattern P1 is read in the direction parallel to the reading direction previously determined. To that end, since most printing devices have their own pre-determined trimming region as shown in FIG. 6, where no image is to be printed stored, as the trimming size (width) information, an image processing device acquires the trimming size (width) information Ta, Tb defining the trimming region from the printing device. Then, the image processing device shifts the illegal copy preventing pattern P by the widths Ta and Tb in the main scanning direction and the sub scanning direction, respectively as shown in FIG. 7A. Next, the image processing device combines the shifted illegal copy preventing pattern P and input image as shown in FIG. 7B. As described, FIGS. 7A and 7B show a process of shifting the illegal copy preventing pattern P and combining the shifted illegal copy preventing pattern P and the input image according to this embodiment of the present invention.

Figure 8:
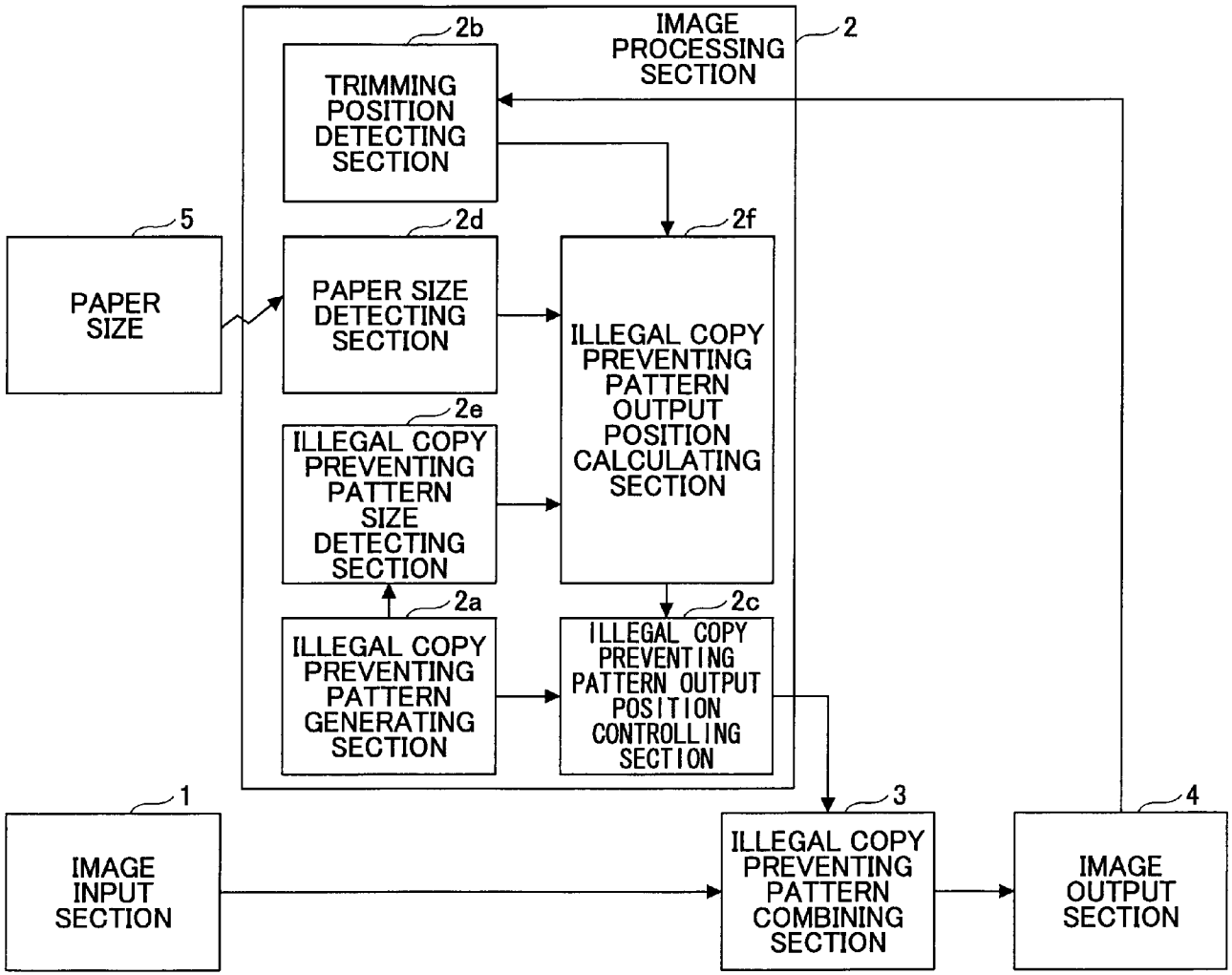
FIG. 8 is a schematic block diagram of an image processing apparatus according to a second embodiment of the present invention.

FIG. 8 is a schematic block diagram of an image processing apparatus performing the process described above. As shown in FIG. 8, an image processing apparatus according to the second embodiment of the present invention further includes a paper size detecting section 2*d*, an illegal copy preventing pattern size detecting section 2*e*, and an illegal copy preventing pattern output position calculating section 2*f* in addition to the configuration shown in FIG. 1. In the configuration shown in FIG. 8, the paper size detecting section 2*d* detects the size of the paper based on paper size information 5. The illegal copy preventing pattern size detecting section 2*e* detects the size of the illegal copy preventing pattern P based on the pattern generation information from the illegal copy preventing pattern generating section 2*a*. The illegal copy preventing pattern output position calculating section 2*f* calculates the output position of the illegal copy preventing pattern P based on the information from the paper size detecting section 2*d*, the illegal copy preventing pattern size detecting section 2*e*, and the trimming position detecting section 2*b*. The calculated output position of the illegal copy preventing pattern P is transmitted to the illegal copy preventing pattern output position controlling section 2*c*. The illegal copy preventing pattern output position controlling section 2*c* shifts the illegal copy preventing pattern P based on the calculated output position of the illegal copy preventing pattern P and transmits the shifted illegal copy preventing pattern P to the illegal copy preventing pattern combining section 3. The illegal copy preventing pattern combining section 3 combines the shifted illegal copy preventing pattern P and an input image and transmits the combined image data to the image output section 4.

Figure 9:
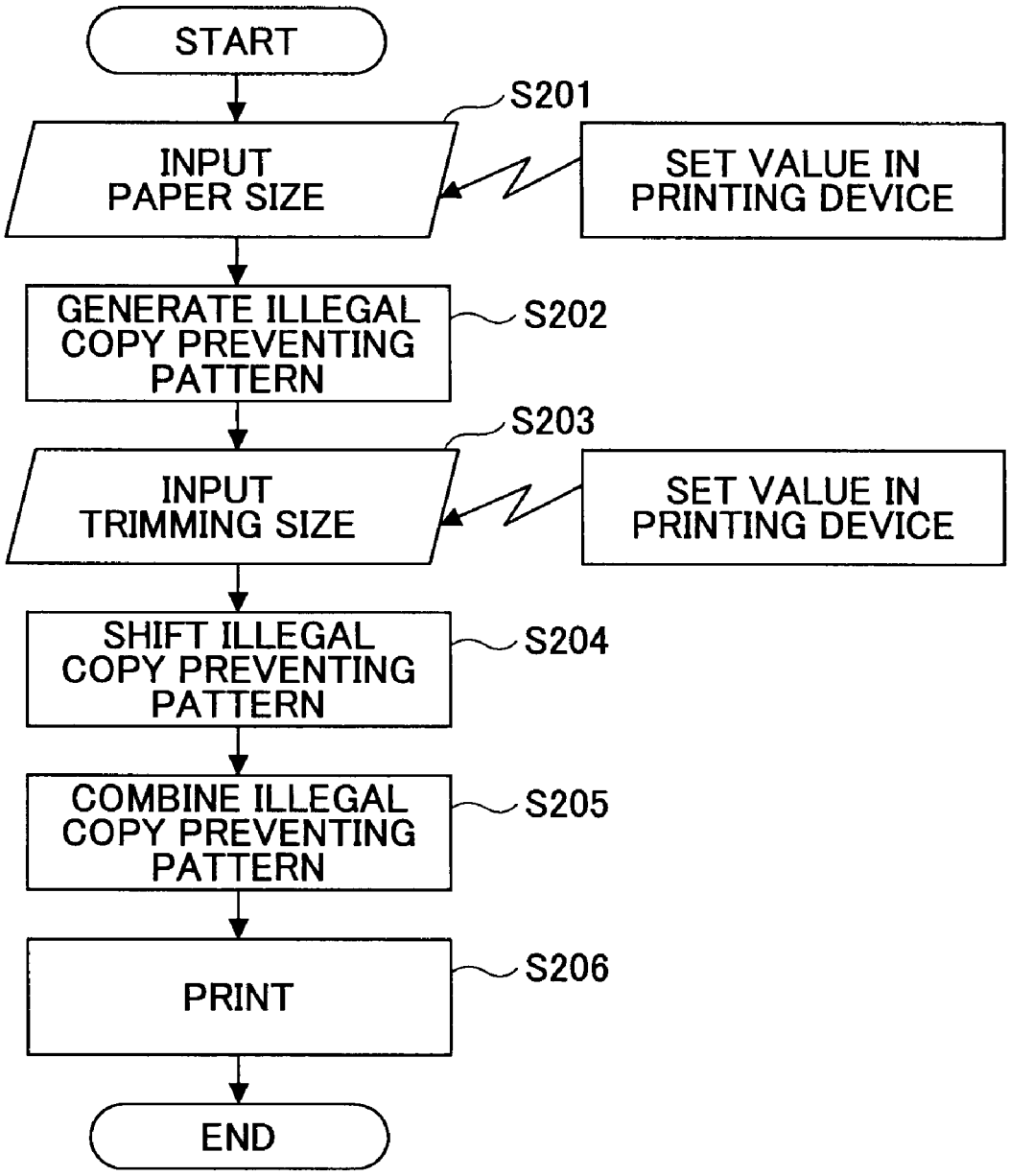
FIG. 9 is a flowchart showing a process of shifting the output position of the illegal copy preventing pattern performed by the image processing apparatus according to the second embodiment of the present invention.

FIG. 9 is a flowchart showing a process including shifting the illegal copy preventing pattern P, performed by the image processing device of FIG.8. By the process shown in FIG. 9, the illegal copy preventing pattern P is shifted and printed so that the first unit pattern P1 can be surely read when read in a reading direction. In the process, first, the size of the printing paper is acquired from the printing device (based on the setting value in the printing device) (step S201). Then, the illegal copy preventing pattern generating section 2*a* generates the illegal copy preventing pattern P having the same size printing paper based on the acquired size of the printing paper (step S202). Next, the print guaranteed position information defining the printing area on the printing paper (or trimming size (width) information defining the non-printing area along the margins of the printing paper) is acquired from the printing device (step S203).

Next, the illegal copy preventing pattern output position calculating section 2*f* calculates the output position of the illegal copy preventing pattern P, and the illegal copy preventing pattern output position controlling section 2*c* shifts the printing position of the illegal copy preventing pattern P so that printing the illegal copy preventing pattern P can be started inside the print guaranteed position area based on the print guaranteed position information (step S204). The shifted illegal copy preventing pattern P and the input image are combined by the illegal copy preventing pattern combining section 3 (step S205). Then, the combined image data are transmitted to the printing device so that the printing device prints the image (step S206). FIG. 7B shows the printed image.

In the above process, the illegal copy preventing pattern P is generated first and the generated illegal copy preventing pattern P is shifted so that the print start position of the unit pattern P1 fits the print start position of the illegal copy preventing pattern P. However, it should be noted that the same effect can be obtained by, for example, changing the order of the steps. For example, when the origin position of the illegal copy preventing pattern P is shifted first before the illegal copy preventing pattern P is generated or when the starting position of combining the illegal copy preventing pattern P and the input image is shifted based on the trimming size (width) information, the same effect can be obtained as long as the print starting position of the illegal copy preventing pattern P can be set at the desired position.

Embodiment 3

Figure 10:
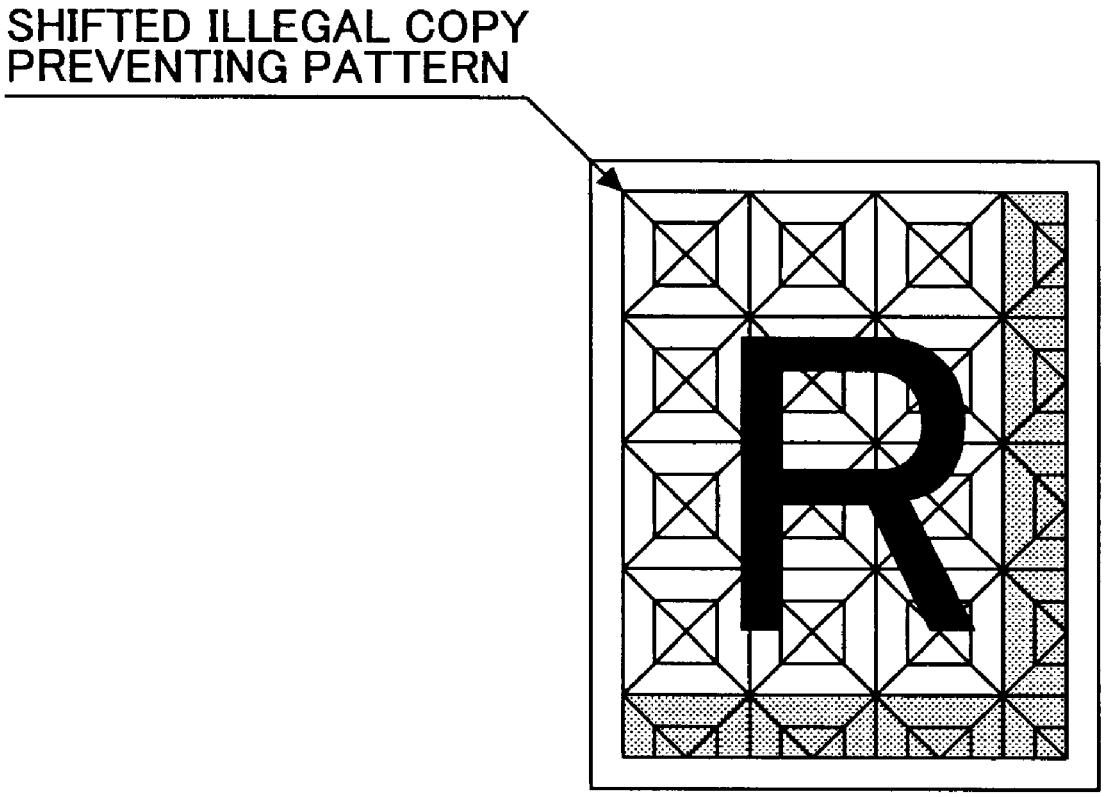
FIG. 10 is a drawing showing a combined image of an printing image and the illegal copy preventing pattern in which the output position of the illegal copy preventing pattern is shifted in accordance with the trimming size (width) information.
Figure 11A:
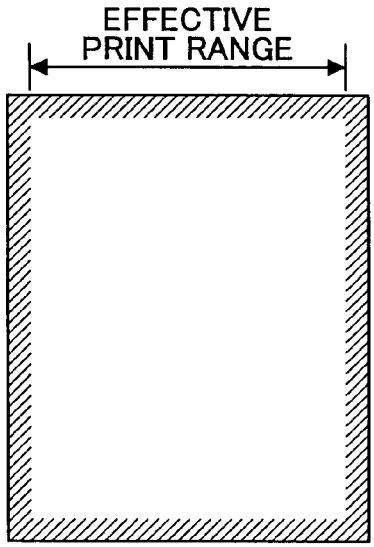
FIG. 11A is a drawing showing an effective print range.
Figure 11B:
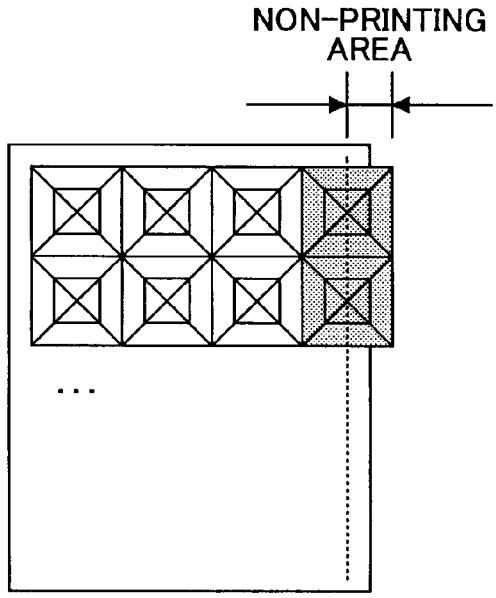
FIG. 11B is a drawing showing where a pattern size in the effective print range is calculated based on the trimming size (width) information and the paper size.

As shown in FIGS. 7B and 10, in the second embodiment, the unit patterns P1 of the shifted illegal copy preventing pattern P are appropriately printed, that is, without being fragmented on the print starting side (front end) of the printing paper. However, unfortunately, the unit patterns P1 on the print ending side (back end) are fragmented, namely, cut in the middle of the patterns. Generally, on a printing paper, there is an effective print range defined as a region other than the trimming region as shown in FIG. 11A. Because of this setting, the illegal copy preventing pattern P in the effective print range is printed but the illegal copy preventing pattern P outside the effective print range is not printed. As a result, each of the unit patterns P1 partially disposed on the area outside the effective print range will be fragmented. Because of this feature, when an image reading device reads the image as shown in FIG. 10 from the side where the unit patterns P1 are fragmented, since the complete unit patterns P1 are arranged from the second unit patterns P1 when counted from the edge (end), the illegal copy preventing function does not work in the shaded portion in FIG. 10.

Figure 12A:
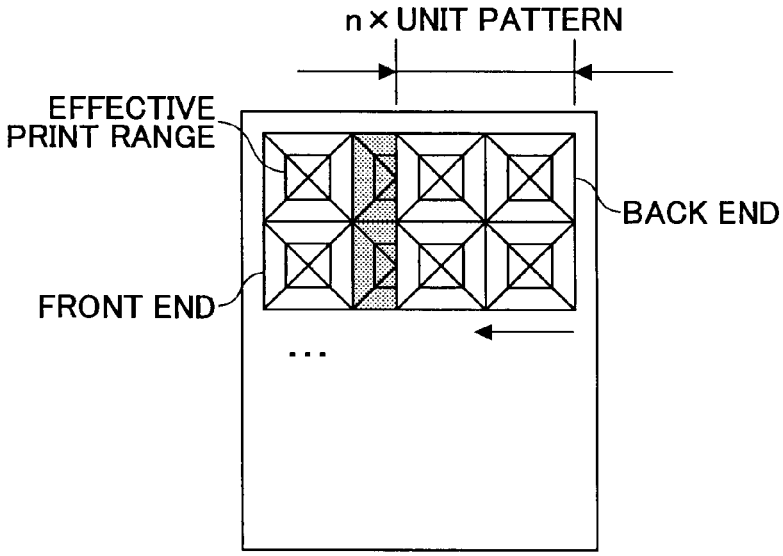
FIGS. 12A and 12B are drawings showing a process of shifting pattern output positions based on print range information and illegal copy preventing pattern size information.

To overcome this disadvantage, in a third embodiment of the present invention, a part of the generated illegal copy preventing pattern P is arranged to be shifted (in the main scanning direction) so that the back end of the illegal copy preventing pattern P fits the back end of in the effective print range as shown in FIG. 12A. In the example of FIG. 12A, a part of the illegal copy preventing pattern P is generated from the front end of the effective print range and the other part of the illegal copy preventing pattern P is also generated from the back end of the effective print range. In this case, the illegal copy preventing pattern P including at least one unit pattern P1 is formed from the front end of the effective print range and the illegal copy preventing pattern P including n unit patterns P1 is also formed from the back end of the effective print range. As a result, as shown in FIG. 12A, the front end of the illegal copy preventing pattern P corresponds to the front end of the effective print range and the back end of the illegal copy preventing pattern P also corresponds to the back end of the effective print range. Therefore, the illegal copy preventing function works when an image reading device reads the image from either of front and back ends in the main scanning direction.

Figure 12B:
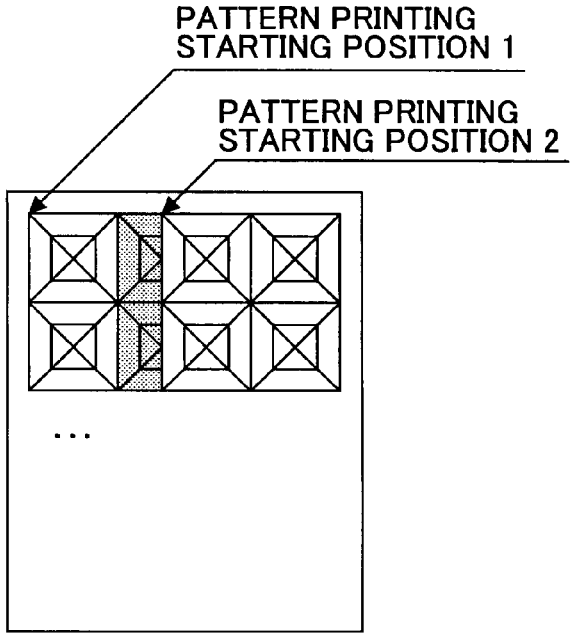

In the example shown in FIG. 12B, the front end position of the second unit pattern P1 when counted from the front end is determined so that the back end position of the illegal copy preventing pattern P thereof corresponds to the back end in the main scanning direction of the effective print range. As a result, similar to the case shown in FIG. 12A, the front and back ends of the illegal copy preventing pattern P correspond to the front and back ends of the effective print range, respectively. Therefore, the illegal copy preventing function works when an image reading device reads the image from either of front and back ends in the main scanning direction.

Figure 13:
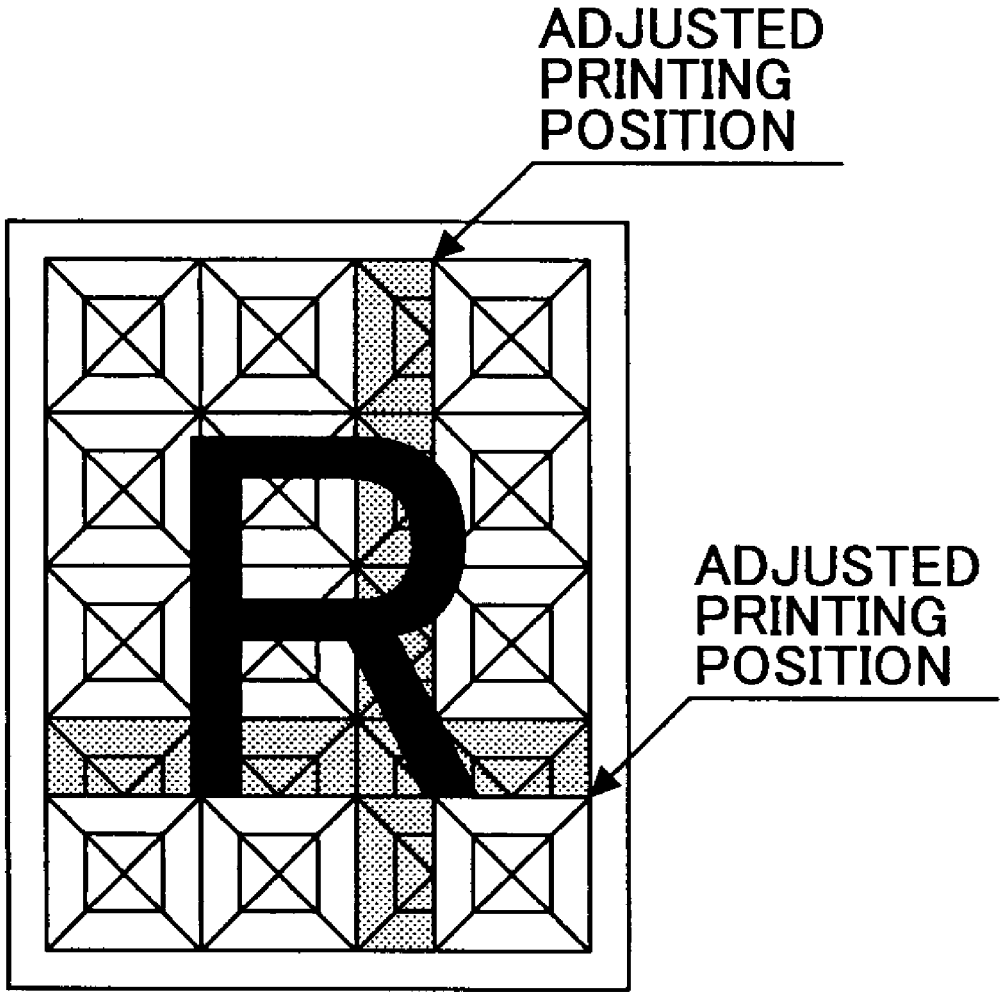
FIG. 13 is a drawing showing where a print ending position of an illegal copy preventing pattern is adjusted based on the print range.

It should be noted that the same as the adjustment described above in the main scanning direction, the adjustment in the sub scanning direction can be performed. FIG. 13 shows an example where the forming starting positions of the illegal copy preventing pattern P are adjusted in both main and sub scanning directions. As FIG. 13 shows, when an image reading device reads the pattern starting at any edge of the four directions parallel in main or sub scanning direction, the illegal copy preventing pattern is recognized from the first unit pattern because there are no fragmented unit patterns at the edge of the effective print range.

Figure 14:
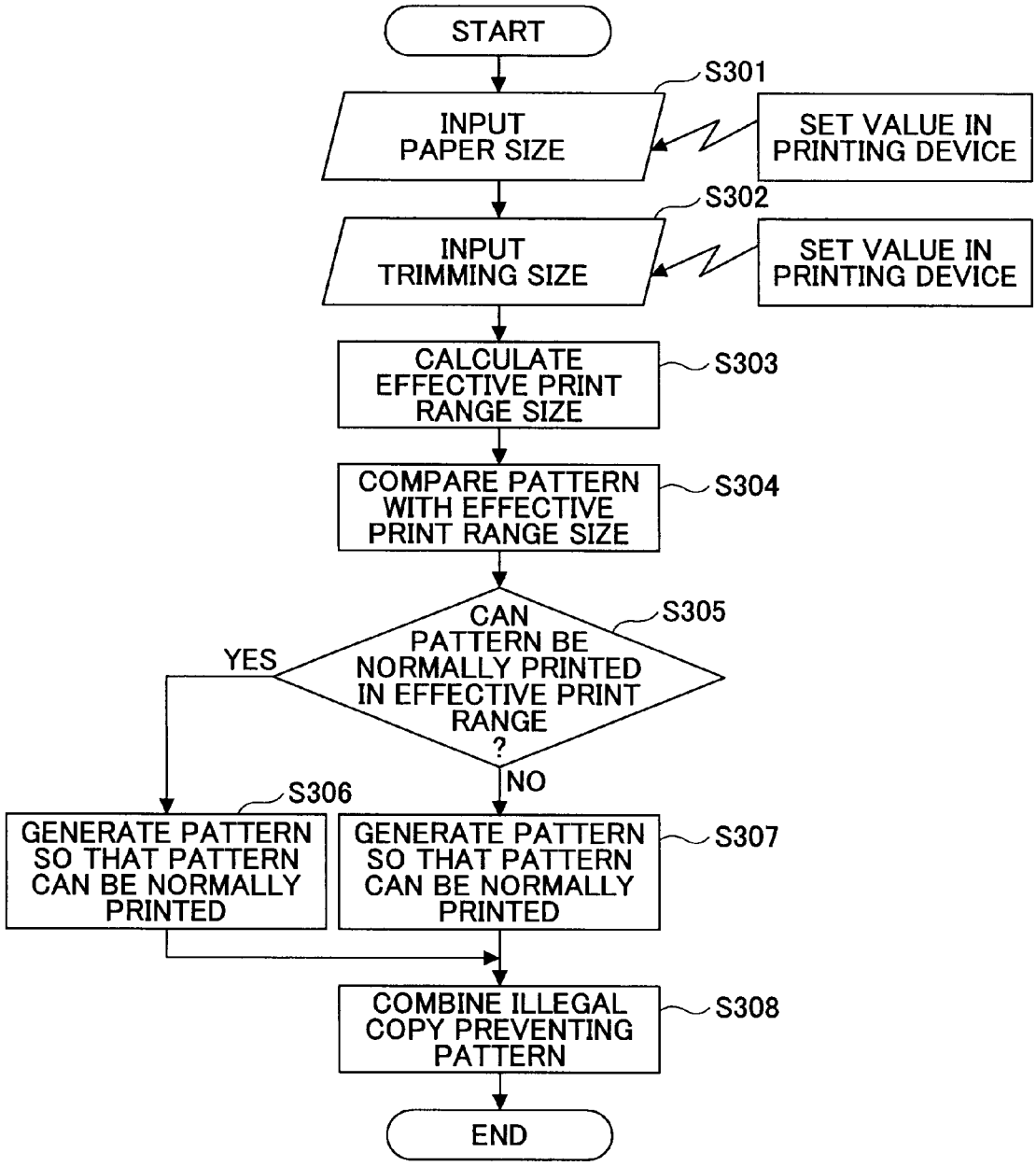
FIG. 14 is a flowchart showing a process of shifting the output position of an illegal copy preventing pattern based on the trimming size information.

FIG. 14 is a flowchart showing a process of this third embodiment of the present invention. First, the size of the printing paper is acquired from the printing device (step S301). The print guarantee area information (or trimming size (width) information) is acquired from the printing device (step S302). Then, the size of the effective print range is calculated based on the acquired size of the printing paper and the trimming size (width) information (step S303).

Next, the size of the illegal copy preventing pattern P is compared with the size of the effective print area (step S304) to determine whether the illegal copy preventing pattern P can be normally printed within the effective print area (step S305). The terms "normally" and "normal" as used herein refer to the status where the sizes of the effective print range in both main and sub scanning directions are integral multiples of the size of unit pattern P1. Therefore, when it is determined that the status is "normal", the illegal copy preventing pattern P1 is generated so that the front and back ends in both main- and sub-scanning directions of the illegal copy preventing pattern P correspond to those of the effective print range (step S306). Then, the generated illegal copy preventing pattern P is combined with the print image data to be printed (step S308).

When it is determined that the status is not "normal", the output positions of the front end or the back end or both of the illegal copy preventing pattern P in main- or sub- or both scanning directions are adjusted (calculated and controlled) so as to correspond to the those of the effective print range and the adjusted illegal copy preventing pattern P is generated based on the adjusted output positions (step S307). Then, the generated illegal copy preventing pattern P is combined with the print image data to be printed (step S308). After the above process is performed, the illegal copy preventing pattern P can be surely detected when an image reading (scanner) device reads the printed result from any of the four directions each in parallel with either the main- or sub-scanning direction.

In the above description, it is assumed that the size of the effective print range is determined based on the paper size and the trimming size (width). However, there may be cases where a user arbitrarily designates the printing position so as to, for example, create binding margins and form punch holes. In this case, the print guarantee area information (trimming size (width) information) is compared with the printing position information designated by the user. When there is a detected area that is included in the print guarantee area but is not included in the printing position information, it is assumed that the print guarantee area within the area defined by the printing position information is the effective print range and the process described above is performed to combine the illegal copy preventing pattern P and the print image data to be printed.

Figure 15:
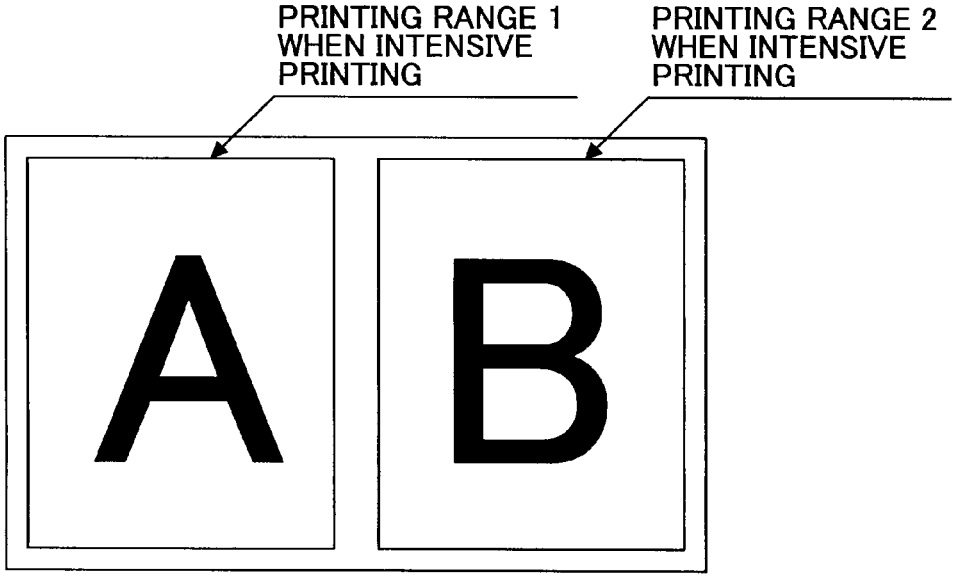
FIG. 15 is a diagram showing a print range of the illegal copy preventing pattern when intensive printing is performed.
Figure 16:
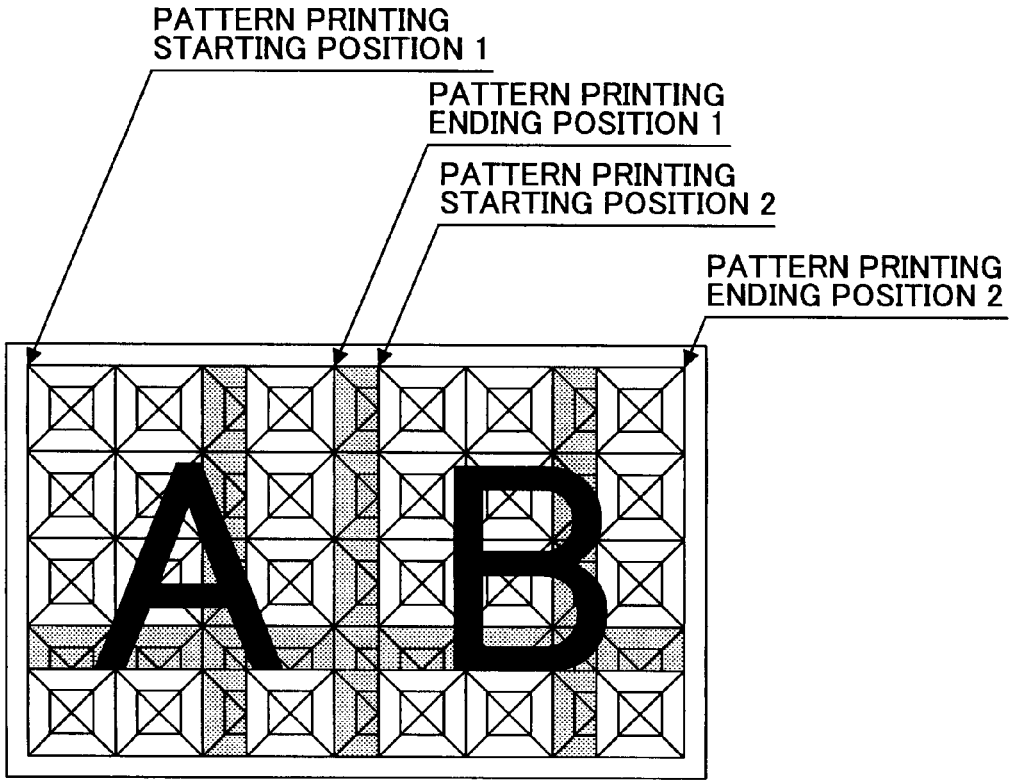
FIG. 16 is a drawing showing where each position of the corresponding illegal copy preventing pattern is adjusted when intensive printing is performed.

Further, when plural pages of printing information as shown in FIG. 15 are printed on a single sheet as intensive printing, the illegal copy preventing patterns P in both main- and sub-scanning directions in both pages are set as shown in FIG. 16. By adjusting and printing the printing positions of the illegal copy preventing pattern P in each page, when the sheet is cut into pages, the illegal copy preventing pattern P on each page is printed with respect to the corresponding printing range as in the case shown in FIG. 13.

Figure 17:
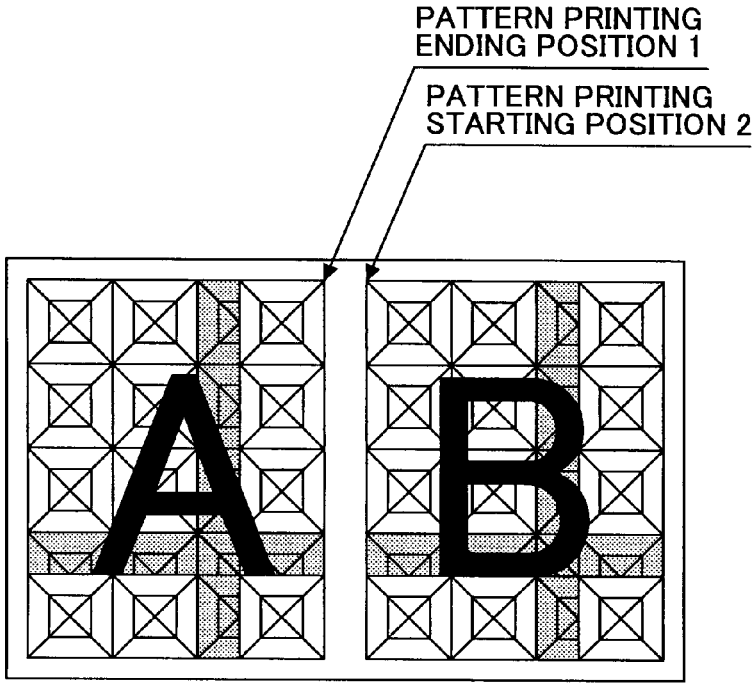
FIG. 17 is a drawing showing the status where the illegal copy preventing pattern is not printed in the middle part of the pages when intensive printing is performed.

On the other hand, as described, when plural pages of printing information as shown in FIG. 17 are printed on a single sheet as intensive printing, the illegal copy preventing pattern P is printed in each page. However, in this case, no illegal copy preventing pattern P is printed between the pages due to adjusting the printing position of the illegal copy preventing pattern P in each page. By this adjustment, advantageously, it is possible to eliminate the difference in appearance between the sheet obtained by cutting the page printed by intensive printing and the page printed without performing intensive printing.

For comparison purposes, FIG. 16 shows an example where the illegal copy preventing pattern P remains between the pattern printing ending position 1 and the pattern printing starting position 2. On the other hand, FIG. 17 shows another example where no illegal copy preventing pattern P is printed between the pattern printing ending position 1 and the pattern printing starting position 2, leaving the area blank. Therefore, as shown in FIG. 17, it is possible to eliminate the difference in appearance between the page obtained by cutting the sheet printed by intensive printing and the page printed without performing intensive printing.

It should be noted that the directions for designating the print range by a user and the setting for preventing printing the illegal copy preventing pattern P between pages are entered via an operations section (not shown) to the image processing section 2, and the processes in accordance with the entered directions and settings are then performed.

It should be noted that the processes described in each above embodiment of the present invention including the corresponding flowcharts are performed by executing a program stored in a ROM (not shown) by a CPU (not shown) using a RAM (not shown) as the working area, each included in the image processing section 2.

Further, each process in the embodiments is described in a computer-readable program to be executed by a CPU. The image processing unit 2 includes a CPU and the CPU executes the operations described above. The computer-readable program can be distributed via, for example, a FD, a CD-ROM, a memory card, or a network and is installed in a computer of the image processing apparatus.

As described above, according to the embodiments of the present invention, 1) the illegal copy preventing pattern having the same size as that of a printing paper can be generated;
2) since the information of the range for printing the illegal copy preventing pattern can be acquired from the printing device, whether or not the size that a user would like to print is different from any of the selectable sizes that can be printed, the illegal copy preventing pattern can be printed in accordance with the size that the user would like to print;
3) the output position of the illegal copy preventing pattern can be adjusted so as not to print on a non-printing area such as the margins of the printing paper defined by, for example, trimming, therefore preventing the fragmentation (truncation) of the illegal copy preventing pattern;
4) since the illegal copy preventing pattern can be printed from all the edges of the print guarantee area, when an image reading device reads from any of the edges of the print guarantee area, the image reading device can recognize the illegal copy preventing pattern from the edge of the print guarantee area;
5) a user can manually adjust the output position of the illegal copy preventing pattern so that the illegal copy preventing pattern is output in accordance with the user's designated printing range and the illegal copy preventing pattern is not output to the non-printing area defined by, for example, trimming;
6) when intensive printing is performed, since the illegal copy preventing pattern can be output on each printing range of the pages of a sheet, it is possible to control the variation in security effect among pages of a sheet;

7) since the illegal copy preventing pattern can be arranged so as not to be printed between the pages, it is possible to eliminate the difference in appearance between the page obtained by cutting the sheet printed by intensive printing and the page printed without performing intensive printing.

The present invention is not limited to the above-mentioned embodiments, and variations and modifications may be made without departing from the scope of the present invention.

The present application is based on and claims the benefit of priority of Japanese Patent Application No. 2007-069535, filed on Mar. 16, 2007, the entire contents of which are hereby incorporated by reference.

What is claimed is:

1. An image processing apparatus configured to output an illegal copy preventing pattern on a paper, the apparatus comprising:

an image output unit configured to output an image to a prescribed region;

an output position setting unit configured to acquire output region information defining the prescribed region from the image output unit, to compare the output region information with the illegal copy preventing pattern, and to determine an output position of the illegal copy preventing pattern based on the result of the comparison; and a combining unit configured to combine the illegal copy preventing pattern and image data based on the output position determined by the output position setting unit, wherein the image output unit is configured to output the image data combined by the combining unit, the image output unit is an image output engine configured to trim image data and to print the trimmed image data; and the output position setting unit is configured to acquire trimming information about the trimming, to compare the trimming information with the illegal copy preventing pattern, and to determine the output position of the illegal copy preventing pattern based on the result of the comparison.

2. The image processing apparatus according to claim 1, further comprising:

a generating unit configured to adjust the output position of the illegal copy preventing pattern based on the output region information defining the prescribed region and generating the adjusted illegal copy preventing pattern.

3. The image processing apparatus according to claim 1, further comprising:

a determining unit configured to determine whether a back end of the illegal copy preventing pattern can be normally output, wherein when it is determined that the back end of the illegal copy preventing pattern cannot be normally output, the output position setting unit adjusts the output position of the illegal copy preventing pattern so that the back end of the illegal copy preventing pattern corresponds to the back end of the prescribed region.

4. The image processing apparatus according to claim 2, wherein the generating unit is configured to generate the illegal copy preventing pattern based on an effective print range on each page in addition to the trimming information.

5. The image processing apparatus according to claim 2, wherein the generating unit is configured to generate illegal copy preventing patterns for the corresponding pages when intensive printing is performed.

6. The image processing apparatus according to claim 5, wherein the generating unit is configured to generate the illegal copy preventing pattern based on effective print ranges of the corresponding pages when intensive printing is performed.

* * * * *